US008911067B2

(12) United States Patent
Herman et al.

(10) Patent No.: US 8,911,067 B2
(45) Date of Patent: Dec. 16, 2014

(54) PRINTING LIQUID TRANSFER AND SUPPLY SYSTEM

(71) Applicants: John L. Herman, Huber Heights, OH (US); Brian W. Gamble, Kettering, OH (US); Dan C. Lyman, Cincinnati, OH (US); David T. Heider, Beavercreek, OH (US); Russell L. Bartley, Urbana, OH (US); Rodney J. Stadum, Dayton, OH (US); Bradley A. Frazier, Miamisburg, OH (US); Michael J. Piatt, Dayton, OH (US)

(72) Inventors: John L. Herman, Huber Heights, OH (US); Brian W. Gamble, Kettering, OH (US); Dan C. Lyman, Cincinnati, OH (US); David T. Heider, Beavercreek, OH (US); Russell L. Bartley, Urbana, OH (US); Rodney J. Stadum, Dayton, OH (US); Bradley A. Frazier, Miamisburg, OH (US); Michael J. Piatt, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 27 days.

(21) Appl. No.: 13/763,887

(22) Filed: Feb. 11, 2013

(65) Prior Publication Data

US 2014/0225945 A1 Aug. 14, 2014

(51) Int. Cl.
*B41J 2/175* (2006.01)
*B41J 2/17* (2006.01)

(52) U.S. Cl.
CPC ..... *B41J 2/175* (2013.01)
USPC ..... 347/86; 347/84

(58) Field of Classification Search
USPC ..... 347/84–86, 89
See application file for complete search history.

(56) References Cited

U.S. PATENT DOCUMENTS 6,139,136 A * 10/2000 Mackay et al. ..... 347/85

FOREIGN PATENT DOCUMENTS

EP 1 013 450 7/2006

* cited by examiner

*Primary Examiner* — Kristal Feggins
(74) *Attorney, Agent, or Firm* — William R. Zimmerli

(57) ABSTRACT

A printing system for printing on a print media includes a first printhead and a second printhead for printing on the print media. A first liquid supply module including a first liquid reservoir is in fluid communication with the first printhead and provides liquid from the first liquid reservoir to the first printhead. A second liquid supply module including a second liquid reservoir is in fluid communication with the second printhead and provides liquid from the second liquid reservoir to the second printhead. A liquid transfer module transfers liquid between the first liquid reservoir and the second liquid reservoir. A method of transferring liquid in the printing system is also provided.

19 Claims, 5 Drawing Sheets

PRINTING LIQUID TRANSFER AND SUPPLY SYSTEM

FIELD OF THE INVENTION

This invention relates generally to inkjet printing systems in which a liquid drop jetted from nozzles are used to form an image on a print media, and in particular to a system and method of insuring color consistency for a multi-printhead system.

BACKGROUND OF THE INVENTION

Inkjet printing systems are being used for printing an expanding range of commercial printing applications. As the range of applications has expanded, a need has developed to extend the printable width of the inkjet printing systems. This need has typically been met by using larger arrays of inkjet printheads. When using a system with multiple printheads, however, it is important that colors printed by each of the printheads be consistent. EP 1 013 450 disclosed a system for supplying ink to multiple printheads from a single liquid supply system. By supplying all the printheads with ink from the same liquid reservoir, the liquid supply system ensured that all the printheads are printing with a common ink.

While the system of EP 1 013 450 is effective, at some point, when a threshold number of printheads is exceeded, the system becomes impractical due to the large flow rates of liquid being supplied to and returned from the large number of printheads. As such, there is an ongoing need to improve how printing liquid is supplied to a large number of printheads.

SUMMARY OF THE INVENTION

According to an aspect of the invention, a printing system for printing on a print media includes a first printhead and a second printhead for printing on the print media. A first liquid supply module including a first liquid reservoir is in fluid communication with the first printhead and provides liquid from the first liquid reservoir to the first printhead. A second liquid supply module including a second liquid reservoir is in fluid communication with the second printhead and provides liquid from the second liquid reservoir to the second printhead. A liquid transfer module transfers liquid between the first liquid reservoir and the second liquid reservoir.

According to another aspect of the invention, a method of transferring liquid in a printing system that prints liquid on a print media includes providing a first liquid supply module including a first liquid reservoir in fluid communication with a first printhead. Liquid is provided from the first liquid reservoir to the first printhead using the first liquid supply module. A second liquid supply module is provided including a second liquid reservoir in fluid communication with a second printhead. Liquid from the second liquid reservoir is provided to the second printhead using the second liquid supply module. Liquid is transferred between the first liquid reservoir and the second liquid reservoir using a liquid transfer module.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
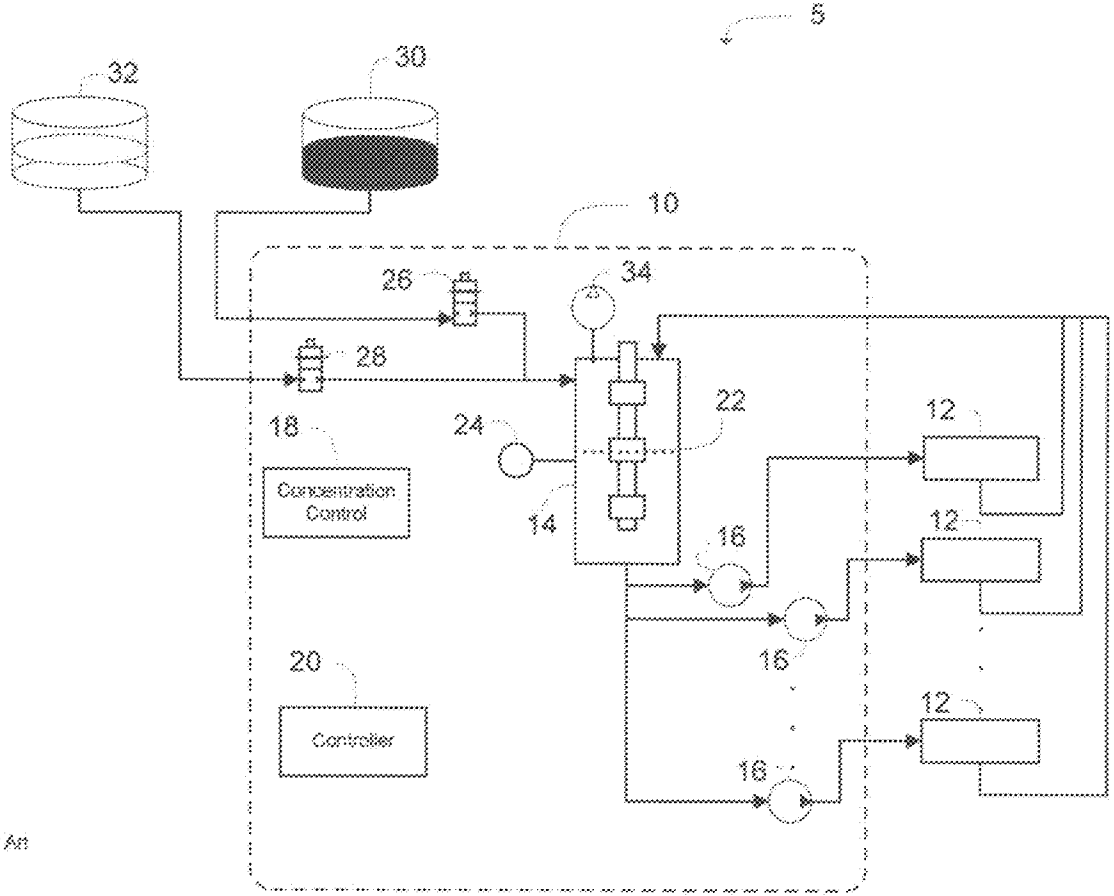
Prior Art FIG. 1
FIG. 1 is a schematic representation of a prior art printing system including a fluid system for supplying liquid to one or more printheads.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example embodiments of the present invention are illustrated schematically and not to scale for the sake of clarity. One of ordinary skill in the art will be able to readily determine the specific size and interconnections of the elements of the example embodiments of the present invention.

Throughout the specification and claims, the following terms take the meanings explicitly associated herein, unless the context clearly dictates otherwise. The meaning of "a," "an," and "the" includes plural reference, the meaning of "in" includes "in" and "on." Additionally, directional terms such as "on", "over", "top", "bottom", "left", "right" are used with reference to the orientation of the Figure(s) being described. Because components of embodiments of the present invention can be positioned in a number of different orientations, the directional terminology is used for purposes of illustration only and is in no way limiting.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper. However, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquids is applied in a consistent, metered fashion, particularly if the desired result is a thin layer or coating.

Inkjet printing is a non-contact application of an ink to a print media. Typically, one of two types of ink jetting mechanisms are used and are categorized by technology as either drop on demand ink jet (DOD) or continuous ink jet (CU). The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CU) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Additionally, there are typically two types of print media used with inkjet printing systems. The first type is commonly referred to as a continuous web while the second type is commonly referred to as a cut sheet(s). The continuous web of print media refers to a continuous strip of media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via rollers and drive wheels or via a conveyor belt system that is routed through the inkjet printing system.

The invention described herein is applicable to both types of printing technologies. As such, the terms printhead and linehead, as used herein, are intended to be generic and not specific to either technology. Additionally, the invention described herein is applicable to both types of print media. As such, the terms web and print media, as used herein, are intended to be generic and not as specific to either type of print media or the way in which the print media is moved through the printing system.

FIG. 1 shows a simplified schematic of a prior art printing system 5 in which a liquid supply system 10 supplies ink to two or more printheads 12 from a common fluid reservoir 14. A pump 16 associated with each printhead pumps the ink from the liquid reservoir to the printhead. The liquid not applied by each of the printheads to the print media is returned to the liquid reservoir. Typically, a vacuum source 34 is connected to the reservoir to provide the means for returning the liquid from the printhead 12 to the reservoir 14. For drawing simplicity, the various valves that control the flow of liquid between the printheads and the reservoir have been omitted. Since the ink is consumed by printing or by evaporation, the ink level in the reservoir drops. The liquid level and the liquid concentration in the liquid reservoir are maintained by a concentration control system 18. The concentration control system can be a portion of the liquid supply system controller 20 or a separate controller. The concentration control system monitors the liquid level in the reservoir 14 using a level sensor 22, and the liquid concentration using a concentration sensor 24. Such sensors are well known in the art. The level sensor 22 is shown in FIG. 1 as including three float switches set for different heights in the liquid reservoir. The concentration control system 20 controls the liquid level using the middle float switch. The low float switch is used to detect an underfill error. If the liquid level gets below the underfill switch, the system shuts down with an underfill error to protect the ink pump from damage due to operation when the reservoir is empty. The upper float switch detects an overfill error. To prevent the vacuum source from ingesting liquid caused by too high of an ink level in the reservoir 14, the system will shut down when an overfill error is detected. The concentration control system opens and closes ink valve 26 and replenishment valve 28 for controlling the flow of fresh ink or replenishment liquid from ink supply tanks 30 and replenishment supply tank 32, respectively, into the reservoir based on the signals from these sensors. The addition of fresh ink to the reservoir makes up for the ink deposited on the print media, while the addition of replenishment liquid makes up for the loss of the solvent components of the ink due to evaporation.

Liquid supply systems of the type shown in FIG. 1 have been used effectively for supplying ink to up to six printheads, spanning print widths of up to 24.5 inches. Anticipated applications for the printing systems include several different print widths ranges up to 60 inches wide. As the print width increases, the number of printheads to be supplied with liquid also increases. As the number of printheads increases and the total flow rate to and from the printheads increases, the size of the reservoir also increases. While the printing systems for each desired print width can be accommodated with a corresponding liquid supply system to supply the needed number of printheads, such an approach becomes unwieldy after a threshold number of printheads is exceeded.

Figure 2:
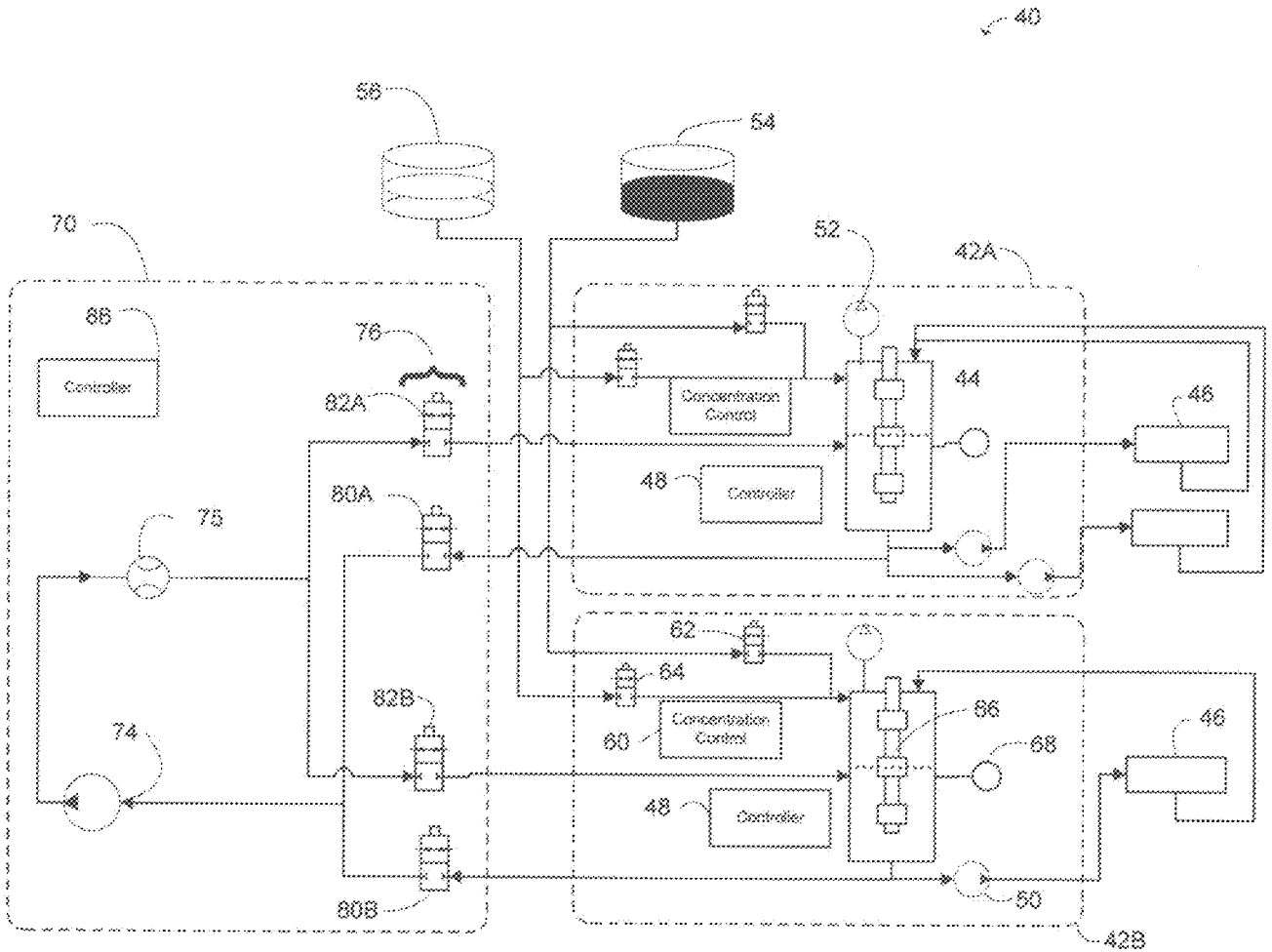
FIG. 2 is a schematic representation of an example embodiment of a printing system with multiple liquid supply modules that supply liquid to a plurality of printheads, and a liquid transfer module that provides liquid having consistent liquid properties to the liquid supply modules.

To overcome this problem, the invention makes use of a number of independent liquid supply modules that are linked together in a way that ensures that ink concentration is consistent from one liquid supply module to another. FIG. 2 shows a schematic of an example embodiment of the invention. The system 40 includes two or more liquid supply modules 42 (two are shown) each with their own liquid reservoir 44 for supplying ink to one or more printheads 46. Liquid supplied by the supply module to each of its one or more printheads that is not used for printing on the print media is returned to the reservoir of the supply module. In FIG. 2, the system is shown having two supply modules 42A and 42B. Supply module 42A is shown supplying ink to two printheads, while the other supply module 42B supplies ink to a single printhead. Each of the liquid supply modules includes a controller 48 and can be operated independently of the other liquid supply modules, so that. For example, liquid supply module 42A can be used to supply print liquid to one or both of its printheads while the other liquid supply module 42B is turned off or are carrying out functions independently of liquid supply module 42A.

Each of the liquid supply modules includes a reservoir 44 from which ink or another liquid is supplied to the associated printheads 46 and to which ink is returned from the associated printheads. The liquid supply modules include an ink pump 52 for each printhead for pumping the ink to the printhead. Each liquid supply module also includes a vacuum source 52 for maintaining its ink reservoir under vacuum. The vacuum on the reservoir provides the force needed to facilitate the return of ink from the printheads to the reservoir. The vacuum also enables the transfer of fresh ink and replenishment liquid from the ink supply tank 54 and replenishment supply tank 56 to the reservoir. Each liquid supply module includes an independent concentration control system 60 that controls the functioning of the ink valve 62 and replenishment valve 64 based on signals from the liquid supply module level sensor 66 and concentration sensor 68.

To avoid print density inconsistency problems that can be produced by different ink concentrations in the different liquid supply modules, the system 40 includes a liquid transfer module 70. The liquid transfer module includes a pump 74, a flow sensor 75 and a set of valves 76 for controlling the flow of liquid between the liquid supply modules. The set of valves 76 includes valves 80C and 80B which control the flow of liquid from the liquid transfer module 70 to the liquid supply modules 42A and 42B, respectively. The valve set 76 also includes valves 82A and 82B which control the flow of liquid to the liquid transfer module 70 from the liquid supply modules 42A and 42B, respectively. The liquid transfer module includes a flow sensor 75 with which it can measure the amount of fluid being transferred between the liquid supply systems. The operation pump and the valves of the liquid transfer module are controlled by the transfer module controller 86. While the illustrated embodiment shows a printing system having two liquid supply modules connected to the liquid transfer module, the invention is not limited to that number. The liquid transfer module can be configured with additional valves to enable it to transfer liquid between three or more liquid supply modules. The liquid transfer module can be used effectively to balance the liquid concentration in printing systems having two or more liquid supply modules.

To carry out the transfer of liquid between the first liquid supply module and the second liquid supply module, the controller of the liquid transfer module energizes valves 80A and 82B and energizes pump 74. This causes liquid to be transferred from liquid supply module 42A into liquid supply modules 42B. Flow sensor 75 is used to measure the amount of liquid transferred between the liquid supply modules. When a prescribed amount of liquid has been transferred, the controller de-energizes the valves 80A and 82B and the pump 74. The controller next energizes valves 80B and 82A and the pump 74 to cause liquid to be transformed from liquid supply module 42B into liquid supply modules 42A. When the prescribed amount of liquid has been transferred, as determined by the flow sensor 75, the controller de-energizes the valves 80B and 82A and the pump 74. This sequence of transferring liquid from liquid supply module 42A into liquid supply modules 42B and from liquid supply module 42B into liquid supply modules 42A is repeated periodically to keep the liquid concentration in the liquid supply modules the same, within acceptable tolerances, when compared to each other. The individual liquid transfer operations can be repeated one right after another to speed up the mixing rate between the liquid supply modules. Pause times of up to five minutes or more between the individual liquid transfers operations can be used once the liquid concentrations in the plurality of fluid supply modules are balanced with each other.

In some applications, where it is extremely critical to maintain matching liquid concentrations in the individual liquid supply modules, the liquid transfer 70 module can be configured to continuously transfer liquid between the liquid supply modules even while one or more of the liquid supply modules are turned off and no liquid is being used for printing and there is no evaporation of the liquid in the reservoirs of the liquid supply modules. After sufficient time to ensure the liquids in the individual liquid supply modules are well mixed, the individual liquid supply modules can be turned on. The output of the concentration sensors 68 of the individual liquid supply modules are relayed by the controllers 48 of the individual liquid supply modules 42 to a system controller. The system controller 86 can then relay back to the liquid supply modules controllers 48 new calibration values so that the concentration control systems 60 of the liquid supply modules can all work to maintain the same liquid concentration.

While the liquid transfer module is carrying out this liquid mixing sequence, the individual liquid supply modules function as they would if they were operated at stand alone fluid systems. The operation of the individual liquid supply modules is carried out under the control of their associated controller 48. They can supply liquid to their associated printheads for printing, and carry out startup, shutdown, and other maintenance functions independently of the operation of the liquid transfer module. The concentration control systems 60 of the individual liquid supply modules operate as they would in standalone liquid supply systems, to add ink or replenishment liquid from the ink supply tank and replenishment supply tank as needed to maintain the liquid level in the individual reservoirs in the prescribed range and the liquid concentration at the desired level as determined by the associated concentration sensor 68.

In the operation of the liquid transfer module, it is critical that same amount of liquid gets transferred into and out of each liquid supply module. Failure to do so can result in a net transfer of liquid from one liquid supply module to another, resulting in low liquid level errors for one liquid supply module and high liquid level errors in another liquid supply module. The flow sensor 75 is used in this embodiment to measure the amount of liquid transferred to ensure a consistent amount of liquid is transferred between the liquid supply modules, independent of the vacuum levels or the liquid level in the reservoirs of the individual liquid supply modules. Preferably, the amount of liquid transferred into or out of the reservoir of the individual liquid supply modules during an individual liquid transfer operation is less than the amount of liquid required to shift liquid level in the reservoirs of the liquid supply modules from their normal levels to either the overfill or the underfill levels. This allows the liquid transfer module to operate without risk of initiating either overfill or underfill errors in any of the liquid supply modules.

Figure 3:
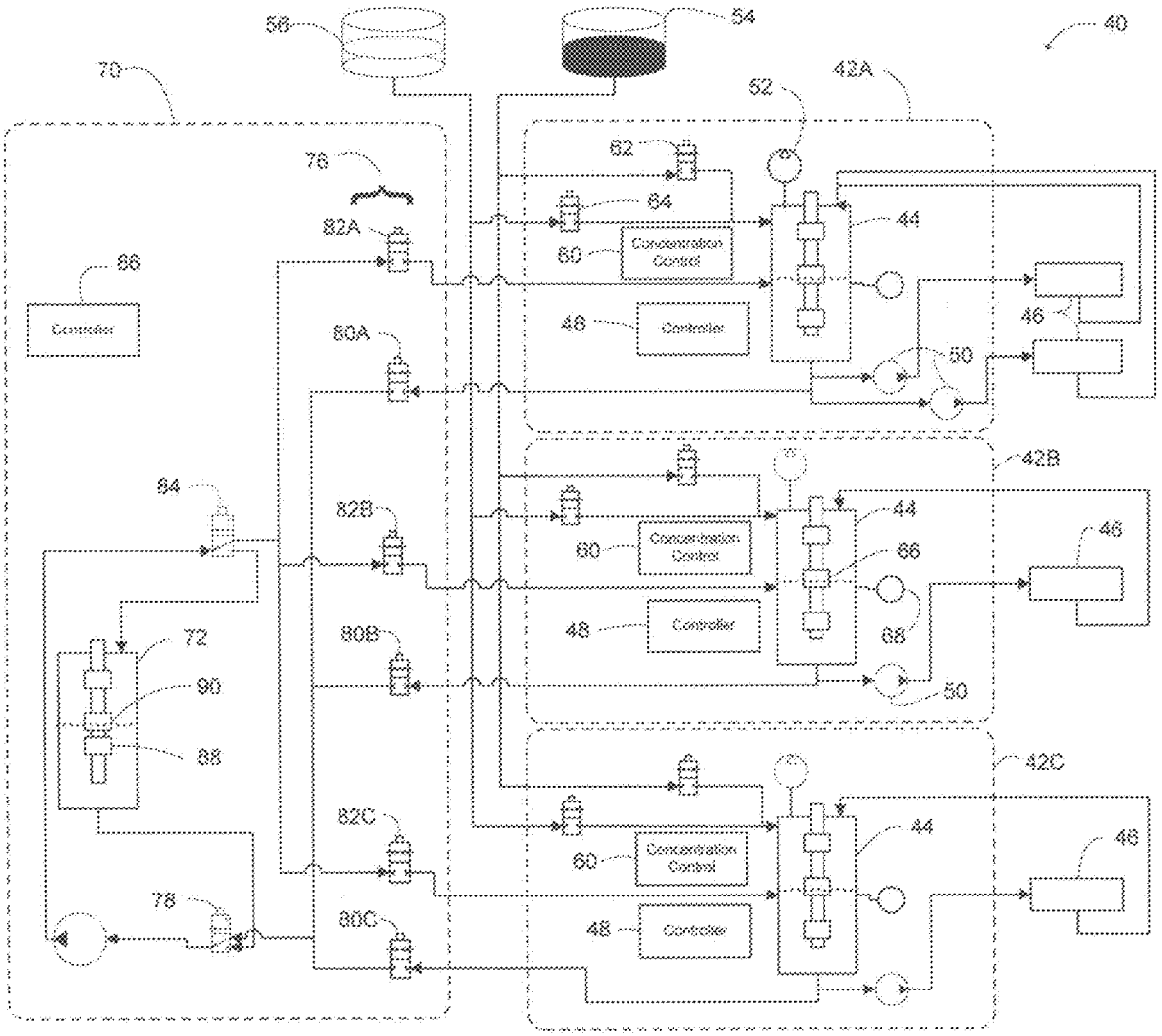
FIG. 3 is a schematic representation of another example embodiment of a printing system with multiple liquid supply modules that supply liquid to a plurality of printheads, and a liquid transfer module that provides liquid having consistent liquid properties to the liquid supply modules.

FIG. 3 shows a schematic of another embodiment of a printing system that has multiple liquid supply modules and a liquid transfer system to transfer liquid between the liquid supply modules. The system 40 includes two or more liquid supply modules 42 (three are shown) each with their own liquid reservoir 44 for supplying ink to one or more printheads 46. Liquid which is supplied by the supply module to each of its one or more printheads that is not used for printing on the print media is returned to the reservoir of the supply module. In FIG. 3, the system is shown having three supply modules 42A, 42B, and 42C. Supply module 42A is shown supplying ink to two printheads, while the other two supply modules 42B and 42C each supply ink to a single printhead. Each of the liquid supply modules includes a controller 48 and can be operated independently of the other liquid supply modules, so that, for example, liquid supply module 42A can be used to supply print liquid to one or both of its printheads while the other two liquid supply modules 42B and 42C are turned off or are carrying out functions independently of liquid supply module 42A.

Each of the liquid supply modules includes a reservoir 44 from which ink is supplied to the associated printheads 46 and to which ink is returned from the associated printheads. The liquid supply modules include an ink pump 52 for each printhead for pumping the ink to the printhead. Each liquid supply module also includes a vacuum source 52 for maintaining the ink reservoir under vacuum. The vacuum on the reservoir provides the force needed to facilitate the return of ink from the printheads to the reservoir. The vacuum also enables the transfer of fresh ink and replenishment liquid from the ink supply tank 54 and replenishment supply tank 56 to the reservoir. Each liquid supply module includes an independent concentration control system 60 that controls the functioning of the ink valve 62 and replenishment valve 64 based on signals from the liquid supply module level sensor 66 and concentration sensor 68.

To avoid print density inconsistency problems that can be produced by different ink concentrations in the different liquid supply modules, the system includes a liquid transfer module 70. The liquid transfer module includes a mixing tank 72, a pump 74, and a set of valves 76 for controlling the flow of liquid to and from each liquid supply module and to and from the mixing tank. The set of valves 76 includes valves 80C, 80B, and 80C which control the flow of liquid from the liquid transfer module 70 to the liquid supply modules 42A, 42B, and 42C, respectively. The valve set 76 also includes valves 82C, 82B, and 82C which control the flow of liquid to the liquid transfer module 70 from the liquid supply modules 42A, 42B, and 42C, respectively. The valve set 76 also includes valve 84. The valve set 76 includes a three way valve 78 that controls whether the pump 74 is pumping liquid out of the mixing tank 72 or out of one of the reservoir of one of the liquid supply modules 42 via one of the valves 82. The valve set 76 also includes a three way valve 84 that controls whether the pump 74 is pumping liquid into the mixing tank 72 or into of one of the reservoir of one of the liquid supply modules 42 via one of the valves 80. The mixing tank 72 of the liquid transfer module 70 includes level sensors 88. The operation pump and the valves of the liquid transfer module are controlled by the transfer module controller 86. While the illustrated embodiment shows a printing system having three liquid supply modules connected to the liquid transfer module, the invention is not limited to that number. The liquid transfer module can be used effectively to balance the liquid concentration in printing systems having two or more liquid supply modules.

The operation of the liquid transfer module will now be described. When the liquid transfer module 70 is first connected to each of the liquid supply modules 42, the transfer module controller 86 energizes valves 82A, 82B, 82C and 84. The controller 86 also energizes pump 74, which pumps liquid out of the reservoirs of liquid supply modules 42A, 42B, and 42C through the valves 82A, 82B, and 82C. The liquid is directed by valve 84 into the mixing tank. Liquid is pumped from each of the liquid supply module reservoirs 44 into the mixing tank until the liquid in the mixing tank trips the low level sensor in the mixing tank. The controller 86, noting the tripped low level sensor 88, de-energizes the valves and the pump. As liquid was drawn out of the reservoirs 44 of each of the liquid supply modules 42, the mixing tank contains a mixture of liquid from each of the reservoirs.

During this initial filling of the mixing tank, the liquid levels in the reservoirs 44 will drop. It is possible that the liquid levels in the reservoirs 44 of one or more of the liquid supply modules 42 could drop sufficiently that the level sensor 66 in the reservoir could detect a low liquid level. The concentration control system 60 of the liquid supply module will respond, as it normally would in the absence of the other liquid supply modules or the liquid transfer module, by opening the ink valve 62 or the replenishment valve 64, based on the liquid concentration determined by the concentration sensor 68 of the liquid supply module. The valve 62 or 64 will be opened (energized) until the liquid level is restored to normal.

After the initial filling of mixing tank, the controller 86, energizes valves 80A and 84, and pump 74 to pump liquid from reservoir 44 of liquid supply module 42A into the mixing tank 72 until the middle level sensor 90 in the mixing tank is tripped by the liquid level. The controller then de-energizes valves 82A and 84 and pump 74 to stop the transfer of liquid from the reservoir of liquid supply module 42A. The controller 86 energizes valves 82B and 78 and pump 74 to pump liquid from the mixing tank into the reservoir of liquid supply module 42B. These valves and pump are energized until the low level sensor detects the drop in liquid level in the mixing tank, at which time valves 82B and 78 and pump 74 are de-energized. This stops the transfer of liquid from the mixing tank to reservoir of liquid supply module 42B. The controller 86 next energizes valves 80B and 84 and pump 74 to begin transferring liquid from the reservoir of liquid supply module 42B into the mixing tank 72. The controller de-energizes energizes valves 80B and 84 and pump 74 when the middle level sensor 90 is again tripped by the rising liquid level in the mixing tank. The controller next energizes valves 82C and 78 and pump 74 to transfer liquid from the mixing tank 72 into the reservoir of liquid supply module 42C. The controller de-energizes these valves and the pump when the low level sensor 88 detects the drop in liquid level in the mixing tank. The controller 86 next energizes valves 80C and 84 and pump 74 to pump liquid from the reservoir of liquid supply module 42C into the mixing tank 72. The controller de-energizes these valves and the pump when the middle level sensor 90 detects the rise in the liquid level in the mixing tank. The controller next energizes valves 82A and 78 and pump 74 to transfer liquid from the mixing tank 72 into the reservoir of liquid supply module 42A. This sequence of transferring liquid from the reservoir of one of the liquid supply modules into the mixing tank, and liquid from the mixing tank into the reservoir of another liquid supply module is carried out the while the printer is operating and can be carried out the entire time the printer is operating.

As with the previous embodiment, the individual liquid supply modules function as they would if they were operated as standalone fluid systems, while the liquid transfer module is carrying out this liquid mixing sequence. The operation of the individual liquid supply modules is carried out under the control of their associated controller 48. They can supply liquid to their associated printheads for printing, and carry out startup, shutdown, and other maintenance functions independently of the operation of the liquid transfer module.

It has been found that this method of transferring liquid, in which the flow of liquid into the mixing tank is stopped upon the detection of the rising liquid level by the middle level sensor 90 and flow of liquid out of the mixing tank is stopped upon the detection of the falling liquid level by the lower level sensor low, yields quite reproducible liquid transfer amounts. As a result, a consistent amount of liquid is transferred into the mixing tank from each of the liquid supply modules, independent of the vacuum levels or the liquid level in the reservoirs of the liquid supply modules. Similarly, a consistent amount of liquid is transferred from the mixing tank into each of the liquid supply modules, independent of the vacuum levels or the liquid level in the reservoirs of the individual liquid supply modules. The spacing between the lower and the middle level sensors 88 and 90 in the mixing tank and the size of the mixing tank are preferably selected to ensure that the amount of liquid transferred into or out of the reservoir of the individual liquid supply modules during an individual liquid transfer operation is less than the amount of liquid required to shift liquid level in the reservoirs of the liquid supply modules from their normal levels to either the overfill or the underfill levels. This allows the liquid transfer module to operate without risk of initiating either overfill or underfill errors in any of the liquid supply modules.

Figure 4:
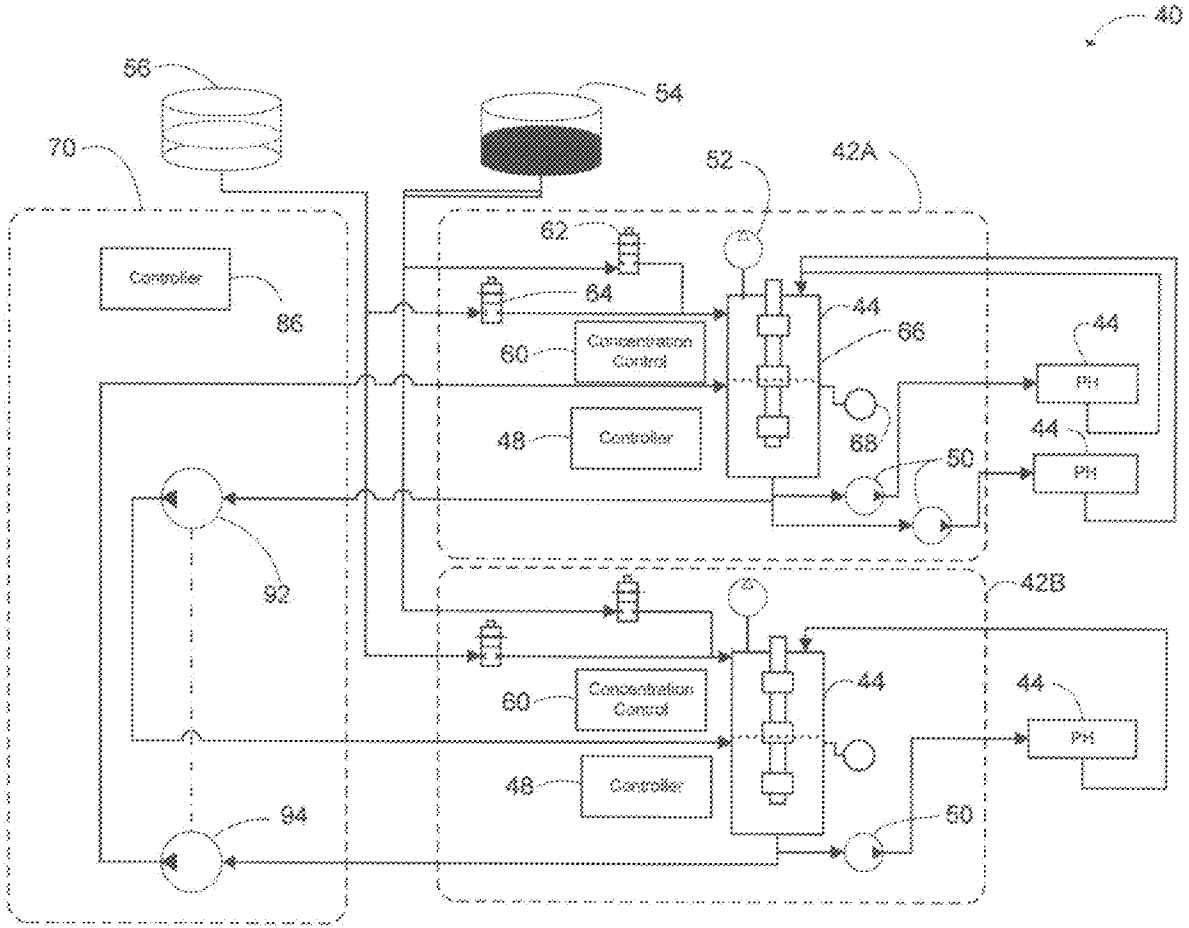
FIG. 4 is a schematic representation of another example embodiment of a printing system with multiple liquid supply modules that supply liquid to a plurality of printheads, and a liquid transfer module that provides liquid having consistent liquid properties to the liquid supply modules.

FIG. 4 shows another embodiment of a printing system with a plurality of liquid supply modules each supplying liquid to one or more printheads, and a liquid transfer module to transfer liquid between the liquid supply modules to ensure that the liquid concentration in the liquid supply modules match each other. Liquid is transferred from liquid supply module 42A to liquid supply module 42B by pump 92, and liquid is transferred from liquid supply module 42B to liquid supply module 42A by pump 94. These pumps are matched to each other so that they each pump the same amount of liquid from one liquid supply module to the other as does the other pump. Appropriate pumps include matched peristaltic pumps driven by a common drive, or matched positive displacement pumps. Depending in part on the type of pump used, the matched set of pumps can be operated either continuously or non-continuous, such as periodic, manner.

Figure 5:
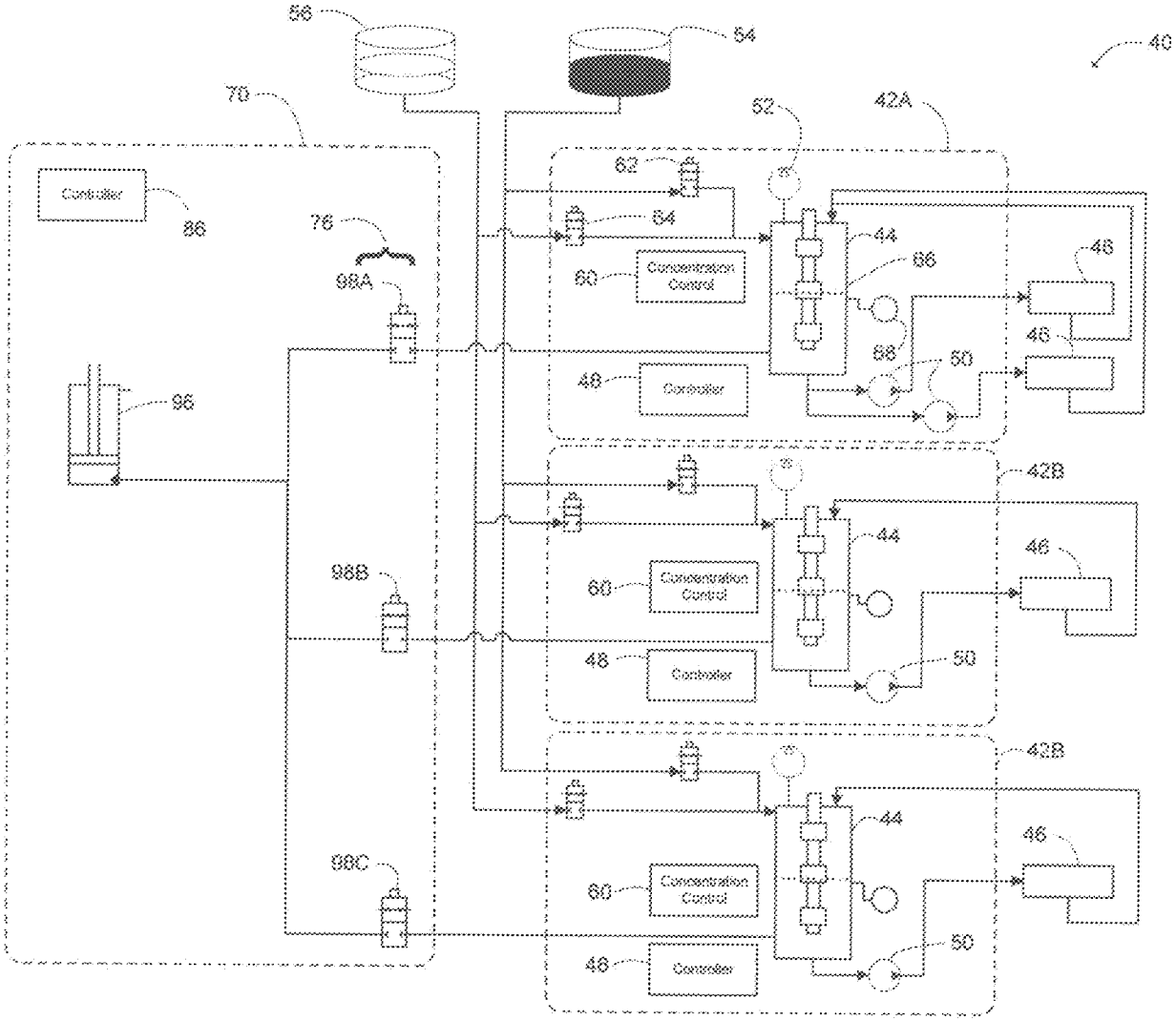
FIG. 5 is a schematic representation of another example embodiment of a printing system with multiple liquid supply modules that supply liquid to a plurality of printheads, and a liquid transfer module that provides liquid having consistent liquid properties to the liquid supply modules.

FIG. 5 shows a schematic of another embodiment of printing system with a plurality of liquid supply modules each supplying liquid to one or more printheads, and a liquid transfer module to transfer liquid between the liquid supply modules to ensure that the liquid concentration in the liquid supply modules match each other. In this embodiment, the liquid transfer module includes a piston pump 96 and valves 98A and 98C, operating under the control of controller 48. To being the transfer of liquid from liquid supply modules 42A to liquid supply modules 42B, the controller energizes valve 98A to open it. The controller 100 activates the piston pump for the suction stroke, drawing liquid from the reservoir 44 of liquid supply module 42A into the piston pump 96. When the suction stroke is complete, valve 98A is closed (de-energized) and valve 98B is opened. The controller then activates the piston pump 96 for its pressure stroke, displacing liquid from the piston pump 96 and pumping it into the reservoir of liquid supply modules 42B. When the pressure stroke is complete, valve 98B is closed (de-energized). The controller next opens valve 98C is opened. The controller activates the piston pump for the suction stroke, drawing liquid from the reservoir 44 of liquid supply module 42C into the piston pump 96. When the suction stroke is complete, valve 98C is closed (de-energized) and valve 98A is opened. The controller then activates the piston pump 96 for its pressure stroke, displacing liquid from the piston pump 96 and pumping it into the reservoir of liquid supply modules 42A. When the pressure stroke is complete, valve 98A is closed (de-energized). The controller next opens valve 98B. The controller activates the piston pump for the suction stroke, drawing liquid from the reservoir 44 of liquid supply module 42B into the piston pump 96. When the suction stroke is complete, valve 98B is closed and valve 98C is opened. The controller then activates the piston pump 96 for its pressure stroke, displacing liquid from the piston pump 96 and pumping it into the reservoir of liquid supply modules 42C. When the pressure stroke is complete, valve 98C is closed. This sequence is repeated to continue the liquid mixing process. The piston pump with its fixed displacement provides a consistent volume of liquid transfer each time the piston is cycled.

With each of these embodiments, the flow rates into and out of the reservoirs 44 of the liquid supply modules preferably are maintained sufficiently low so that that the flow does not affect the pressure inside the reservoir. This should be done as pressure fluctuations in reservoir could be transferred through the liquid supply module as pressure fluctuations to the printhead, where they could affect the density of the printed images.

The invention has been described in detail with particular reference to certain preferred embodiments thereof, but it will be understood that variations and modifications can be effected within the scope of the invention.

PARTS LIST

5 Printing System
10 Fluid System
12 Printhead
14 Reservoir
16 Pump
18 Concentration Control System
20 Controller
22 Level Sensor
24 Concentration Sensor
26 Ink Valve
28 Replenishment Valve
30 Ink Supply
32 Replenishment Supply
34 Vacuum Source
40 Printing System
42 Supply Module
44 Liquid Reservoir
46 Printhead
48 Controller
50 Ink Pump
52 Vacuum Source
54 Ink Supply
56 Replenishment Supply
60 Concentration Control System
62 Ink Valve
64 Replenishment Valve
66 Level Sensor
68 Concentration Sensor
70 Liquid Transfer Module
72 Mixing Tank
74 Pump
75 Flow Sensor
76 Valve Set
78 Valve
80 Valve
82 Valve
84 Valve
86 Controller
88 Level Sensor (Low)
90 Level Sensor (Middle)
92 Pump
94 Pump
96 Piston Pump
98 Valve

The invention claimed is:

1. A printing system for printing on a print media comprising:

a first printhead for printing on the print media;

a first liquid supply module including a first liquid reservoir in fluid communication with the first printhead, the first liquid supply module providing liquid from the first liquid reservoir to the first printhead;

a second printhead for printing on the print media;

a second liquid supply module including a second liquid reservoir in fluid communication with the second printhead, the second liquid supply module providing liquid from the second liquid reservoir to the second printhead; and a liquid transfer module that transfers liquid between the first liquid reservoir and the second liquid reservoir, wherein the first liquid supply module provides liquid from the first printhead back to the first liquid reservoir.

2. The system of claim 1, further comprising a liquid concentration control system.

3. The system of claim 1, wherein the liquid transfer module includes a pump for transferring liquid between the first liquid reservoir and the second liquid reservoir.

4. The system of claim 1, the liquid transfer module including a mixing tank that receives liquid from at least one of the first liquid reservoir and the second liquid reservoir, wherein liquid transferred between the first liquid reservoir and the second liquid reservoir is transferred via the mixing tank.

5. The printing system of claim 4, wherein the liquid transfer module includes a valve set that controls liquid flow into and out of the mixing tank.

6. The system of claim 1, wherein the first liquid supply module includes a first controller configured to control operation of the first liquid supply module.

7. The system of claim 6, wherein the first controller monitors liquid concentration in the first liquid reservoir.

8. The system of claim 1, wherein the second liquid supply module includes a second controller configured to control operation of the second liquid supply module.

9. The system of claim 8, wherein the second controller monitors liquid concentration in the second liquid reservoir.

10. The system of claim 1, wherein the liquid transfer module includes a controller configured to control operation of the liquid transfer module.

11. The system of claim 10, further comprising:

a third printhead for printing on the print media;

a third liquid supply module including a third liquid reservoir in fluid communication with the third printhead, the third liquid supply module providing liquid from the third liquid reservoir to the third printhead, wherein the liquid transfer module transfers liquid between the first liquid reservoir, the second liquid reservoir, and the third liquid reservoir.

12. The system of claim 11, wherein the liquid transfer module controller is configured to receive a signal from at least one of the first liquid supply module, the second liquid supply module, and the third liquid supply module that indicates an operational status of the module, the liquid transfer module controller being configured to adjust transfer of liquid between the first liquid reservoir, the second liquid reservoir, and the third liquid reservoir based on the operation status of the module.

13. The systems of claim 10, wherein the liquid transfer module controller is configured to monitor liquid concentration in the first liquid reservoir and liquid concentration in the second liquid reservoir.

14. The systems of claim 10, wherein the liquid transfer module controller is configured to transfer liquid between the first liquid reservoir and the second liquid reservoir in a non-continuous manner.

15. The system of claim 1, wherein the liquid transfer module transfers equal amounts of liquid between the first liquid reservoir and the second liquid reservoir.

16. The system of claim 15, wherein the liquid transfer module includes a device that monitors the amount of liquid transferred between the first liquid reservoir and the second liquid reservoir.

17. The system of claim 1, wherein the first liquid supply module provides liquid from the first liquid reservoir to another printhead in addition to the first printhead.

18. A printing system for printing on a print media comprising:

a first printhead for printing on the print media;

a first liquid supply module including a first liquid reservoir in fluid communication with the first printhead, the first liquid supply module providing liquid from the first liquid reservoir to the first printhead;

a second printhead for printing on the print media;

a second liquid supply module including a second liquid reservoir in fluid communication with the second printhead, the second liquid supply module providing liquid from the second liquid reservoir to the second printhead; and a liquid transfer module that transfers liquid between the first liquid reservoir and the second liquid reservoir, wherein the a liquid transfer module includes a valve set that controls liquid flow from the first liquid reservoir to the second liquid reservoir and from the second liquid reservoir to the first liquid reservoir.

19. A method of transferring liquid in a printing system that prints liquid on a print media comprising:

providing a first liquid supply module including a first liquid reservoir in fluid communication with a first printhead;

providing liquid from the first liquid reservoir to the first printhead using the first liquid supply module;

providing liquid from the first printhead back to the first liquid reservoir using the first liquid supply module;

providing a second liquid supply module including a second liquid reservoir in fluid communication with a second printhead;

providing liquid from the second liquid reservoir to the second printhead using the second liquid supply module; and transferring liquid between the first liquid reservoir and the second liquid reservoir using a liquid transfer module.

* * * * *